US005505186A

United States Patent [19]

Stagnero

[11] Patent Number: 5,505,186

[45] Date of Patent: Apr. 9, 1996

[54] ELASTIC RING PROJECTING GUN

[76] Inventor: Michael Stagnero, 29 Armamino Ct., Oakland, Calif. 94618

[21] Appl. No.: 187,642

[22] Filed: Jan. 27, 1994

[51] Int. Cl.[6] ..... F41B 7/02

[52] U.S. Cl. ..... 124/19; 124/18; 124/48

[58] Field of Search ..... 124/19, 18, 17, 124/16, 20.2, 45, 25, 35.1

[56] References Cited

U.S. PATENT DOCUMENTS

| | | | |
|---|---|---|---|
| 1,779,507 | 10/1930 | White | 124/18 |
| 1,826,053 | 10/1931 | Carpenter . | |
| 1,892,209 | 12/1932 | Fisher . | |
| 2,289,490 | 7/1942 | Fisher | 124/19 |
| 2,408,984 | 10/1946 | Lawson | 124/17 |
| 2,550,873 | 5/1951 | Siders | 124/19 |
| 2,689,558 | 9/1954 | Sealer et al. | 124/19 |
| 3,670,711 | 6/1972 | Firestone | 124/25 |
| 3,693,609 | 9/1972 | Vodinh | 124/19 |
| 3,757,760 | 9/1973 | Darnell | 124/19 |
| 4,223,658 | 9/1980 | Sundstrom | 124/19 |
| 4,308,850 | 1/1982 | Hunter | 124/19 |
| 4,800,864 | 1/1989 | Small | 124/19 |
| 4,949,494 | 8/1990 | Mims | 42/54 |
| 5,205,266 | 4/1993 | Kilby | 124/19 |
| 5,215,069 | 6/1993 | Liu | 124/25 |
| 5,222,472 | 6/1993 | Landingham | 124/19 |

*Primary Examiner*—Anthony Knight

[57] ABSTRACT

A toy gun is provided for ejecting a plurality of high tension elastic bands in rapid succession. The gun includes a frame having a barrel and a handle. A longitudinal recession in the barrel rotatably supports a spring loaded cylindrical band holding magazine which supports a plurality of high tension bands in a fully stretched condition. A trigger element is mounted within the frame and permits controlled movement of the cylindrical magazine to eject the high tension bands with successive pulls of the trigger. A lever device is included in the handle of the gun for positioning the high tension bands on the magazine in a condition of maximum elongation.

15 Claims, 3 Drawing Sheets

ELASTIC RING PROJECTING GUN

BACKGROUND AND SUMMARY OF THE INVENTION

The present invention relates to a toy gun which is capable of projecting a plurality of high tension elastic rings in rapid succession after a single loading.

Heretofore many toy guns have been developed which fire rubber bands. Such toy guns generally employ a sprocket wheel holder, rotatably disposed on an axis transverse to the frame of the gun, which engages one or more standard rubber bands and a trigger mechanism which serially releases the bands by permitting limited rotation of the sprocket. Examples may be found in U.S. Pat. No. 1,826,053 to Carpenter, U.S. Pat. No. 1,892,209 to Fisher, U.S. Pat. No. 2,289,490 to Fisher, U.S. Pat. No. 2,550,873 to Siders, U.S. Pat. No. 2,689,558 to Sealer et. al., U.S. Pat. No. 4,223,658 to Sundstrom, U.S. Pat. No. 4,308,850 to Hunter, U.S. Pat. No. 4,949,494 to Mims and U.S. Pat. No. 5,205,266 to Kilby. Such mechanisms, which eject standard rubber bands, do not permit the use of high tension bands which exhibit superior aerodynamics. Moreover, the band holding mechanisms generally hold the bands in a less than fully elongated condition prior to firing, thereby resulting in a band being released with an energy less than its full potential. Therefore, while being conveniently hand loadable, they do not provide for accurate long range exciting power.

Accordingly, one object of the present invention is the provision of a toy gun which may be loaded with high tension rubber rings as projectiles. Another object of the present invention is to provide a mechanism that employs leverage to mount the elastic rings in a stretched condition ready for firing. A further object of the present invention is the provision of an elastic band holder strong enough to support a plurality of high tension elastic rings in uniform maximum elongation. Yet another object of the present invention is the provision of a toy gun having a manually operated knob mechanism for spring loading the ring holding mechanism in a rotational movement bias. Still another object of the present invention is the provision of a trigger mechanism that sequentially both limits the rotational movement of the ring holder and fires the rings.

These and other objects of the present invention are attained by the provision of a mechanism for ejecting a plurality of high tension elastic bands in rapid succession. The mechanism may be conveniently installed in a toy gun which includes a frame having a handle. A spring loaded cylindrical band retaining magazine which supports a plurality of high tension bands or rings in a fully stretched condition is rotatably supported along a longitudinal axis of the frame. A trigger element is mounted on the frame which permits controlled rotation of the cylindrical magazine to position an elastic projectile in the proper location for firing and causes ejection of the high tension elastic rings or bands with successive pulls of the trigger. A lever device is included in the handle of the gun for loading the high tension bands on the magazine in a condition of maximum elongation.

Other objects and advantages of the present invention will be more apparent from the following detailed description of preferred embodiments, when taken in conjunction with the drawings.

DETAILED DESCRIPTION OF THE PREFERRED EMBODIMENT

Figure 1:
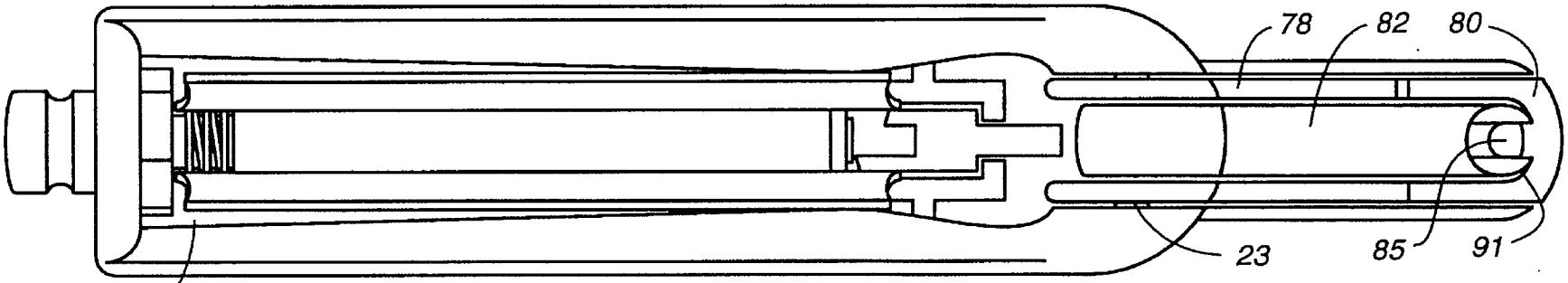
FIG. 1 is a top view of the gun, showing the position of the ring retainer vanes when the trigger is in the at rest position.
Figures 2, 3:
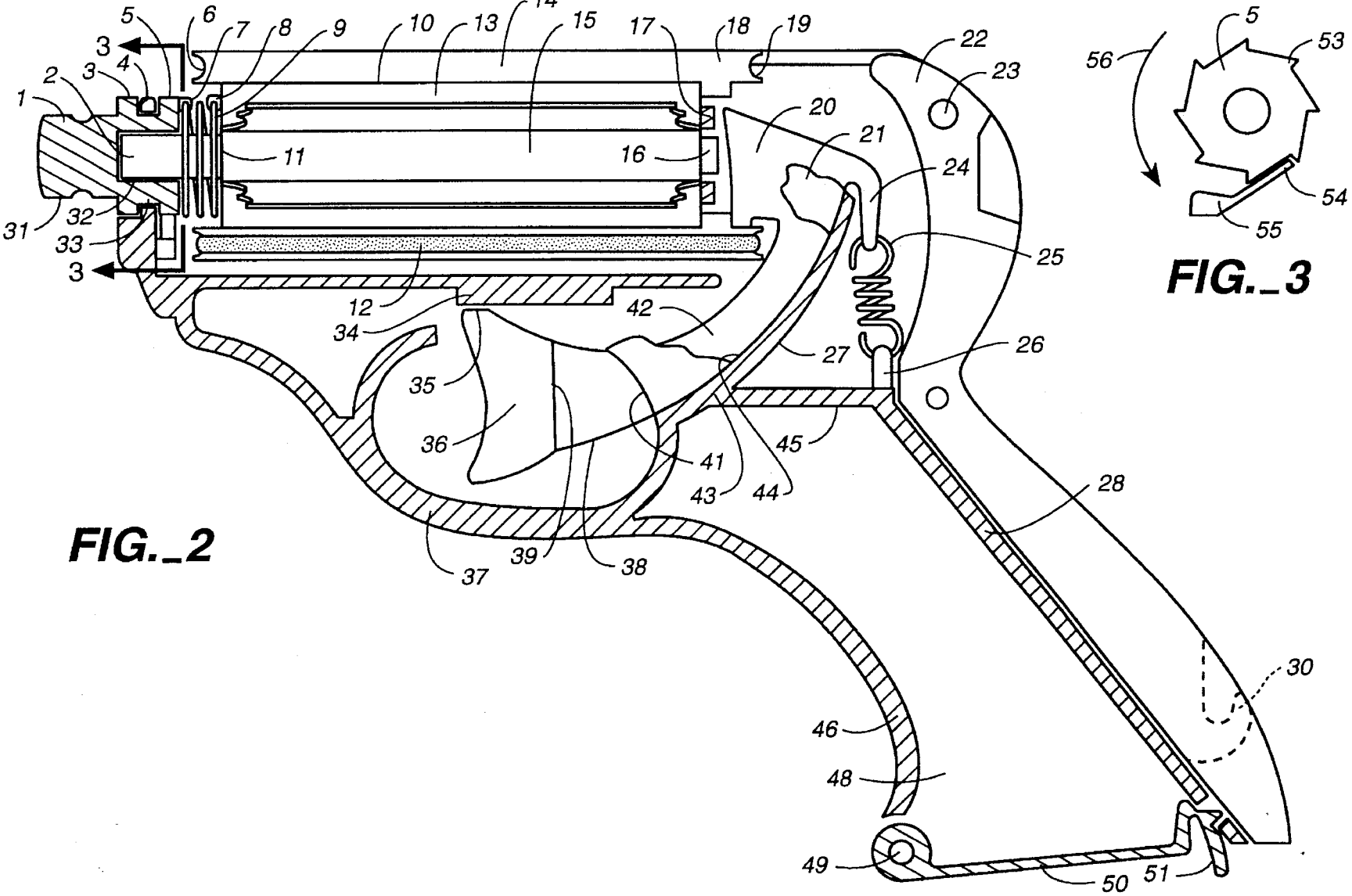
FIG. 2 is a detail longitudinal section with the two central vane ends removed to permit viewing of the parts at the cylinder ends, and with a ring loaded onto the lower vane.
FIG. 3 is a rear view of the ratchet mechanism taken on the Line 3—3 in FIG. 2.

Referring to FIGS. 1 and 2, the ring retainer 15 lies within a cavity formed by the opposing side walls of the frame and is exposed to the outside by a longitudinally extending opening 58 in the top wall from the front of the frame to the rear to facilitate loading and firing.

The ring retainer is in the form of a longitudinally extending cylinder 13 having a plurality of longitudinal vanes 14 radially extending therefrom.

The front and rear portions of the vanes extend longitudinally beyond the front and rear extremities of the cylinder 13 and are notched with concave recesses 6 and 19 on their ends for receiving the elastic projectile rings.

The rear recessed end of the vanes contains a lower stepped portion 18 that extends radially inward beyond the surface 10 of the cylinder 13. A cylindrical shaft 16 axially extending from the rear hub portion of the cylinder is rotatably mounted in a receiving hole in an extension 17 of the trigger support portion 27 of the frame. The cylinder thus mounted is free to rotate about its longitudinal axis.

Spring 9 is situated around the front shaft 2 between the forward end 11 of the cylinder 13 and the ratcheted end of the winding knob 31 with the spring's rear end secured against a peg 8 that projects forwardly from the front end of the cylinder 13.

Referring now to Jig. 2, a ratcheted winding knob 31 is supported around its shaft 33 by the forward portion 4 of the frame and held in a longitudinally rotatable position in the frame by its shoulders 3 and 5 integrally formed with the shaft.

An axially positioned cylindrical opening 32 extends through the shaft 33 and rear shoulder 5 to receive and support the forward ring retainer shaft 2 in a like rotatable position.

Disposed forward of the ring retainer 15 the knob has an outer periphery diameter that is equal to or slightly less than the outer diameter 10 of the cylinder 13 to allow for a clear trajectory of the released rings.

An extension 1 is provided integrally formed and forwardly projecting from the forward shoulder 3 as a manually operated grip for rotating the knob.

A series of ratchet teeth 53, shown in FIG. 3, are cut out of the periphery of the rear shoulder, each step being sequentially engagable with a corresponding portion 54 of a pawl 55 to permit rotational motion in one direction 56 only. This allows the operator to wind the coil spring 9 by twisting the knob against the resistance of the spring.

The pawl 55 is held in a resiliently held engagable position in the ratchet teeth 53 and blocks the rotational movement of the knob from the biasing urge of the torsional coil spring 9, mounted at its forward end to the knob by an extension peg 7 projecting rearward from the rear shoulder 5.

When manually wound and held in tension by the winding knob 31 spring 9 rotationally biases the ring retainer 15.

Referring to FIGS. 2, 4, 5 and 6, a trigger mechanism 38 disposed posteriorly and below the rear portion of the ring retainer 15 is slidably received within a channel 27 formed from an extension of the rear side wall portion of the frame. It includes a lower arcuate trigger portion 36 which lies within the trigger guard 37.

Its upper portion 20 includes two forwardly projecting arms 60 and 62 spaced to form a groove 61 . A rearwardly depending member 24 secures an extension coil spring 25 to the trigger.

Figure 6:
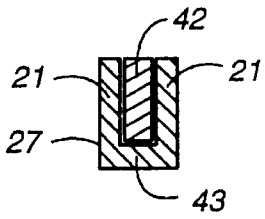
FIG. 6 is a section of the channel taken on Line 6—6 in FIG. 5.
Figure 5:
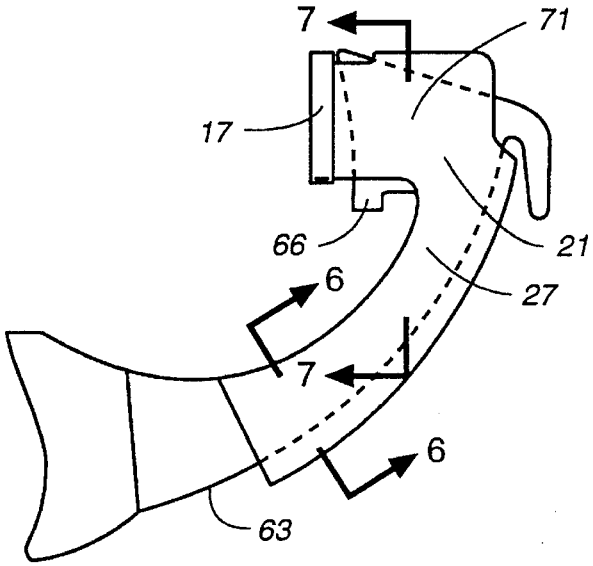
FIG. 5 is a longitudinal view of the trigger mechanism within its supporting channel.

The curved rear margin 63 of the trigger leg 42 describes a partial circle and slides upon a corresponding inner surface 44 of a stabilizing wall portion 43 of the channel 27. Referring to FIG. 6, the channel 27 is composed of two side walls 21 and a rear wall 43 together forming an elongated curved channel with a u-shaped cross section. Extending rearwardly from the wall portion 43 is the upper handle frame 45.

Extending upwardly from the upper handle frame 45 is the spring support arm 26, which has a point of attachment for spring 25 that aligns the spring in a downward and rearward position from its attachment point on arm 24. This provides for a rearward pull on the trigger arm which helps to resiliently secure it in the channel. When the trigger is pulled this spring alignment maintains the trigger leg 42 in a fully seated position in the channel throughout the trigger's travel.

The pull of spring 25 on the trigger causes the upper portion 35 of the trigger piece to rise. This affect is countered by the lower surface of the frame portion 34, that holds the trigger piece 36 down when the trigger is in a lowered at rest position.

Figure 4:
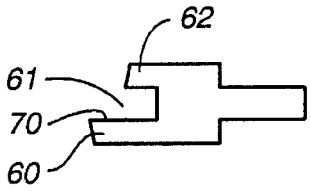
FIG. 4 is a top view of the upper trigger mechanism.
Figure 7:
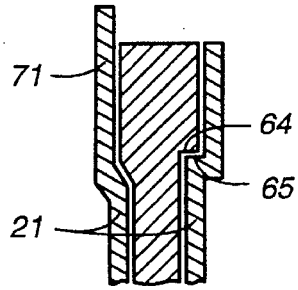
FIG. 7 is a vertical section taken on the line 7—7 in FIG. 5.
Figure 11:
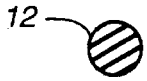
FIG. 11 is a section of the ring, taken on the Line 11—11 in FIG. 10.

Referring to FIGS. 4 and 7, the arm 62 has as its lower edge a shoulder 64 which abuts the upper edge 65 of the channel wall 21 and arrests the downward movement of the trigger mechanism in a resiliently retained inoperative position urged by the trigger spring 25.

Figure 8:
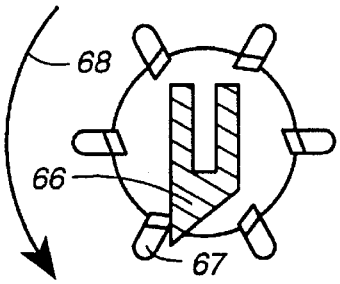
FIG. 8 is a rear view of the retainer mechanism, showing the upper trigger portion in an at rest position.

In this position, referring to FIG. 8, the lower extension 66 of the arm 60 engages a side of the lower vane 67 and interrupts its circumferential rotation in direction of arrow 68.

Figure 9:
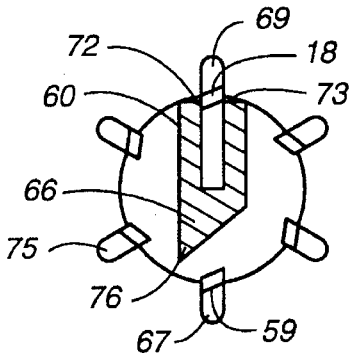
FIG. 9 is a similar rear view showing the upper trigger portion in a ready-to-fire or ready-to-load position.
Figure 10:
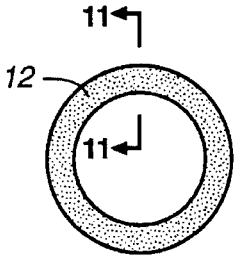
FIG. 10 is a top view of the elastic ring.

When the trigger is partially pulled, referring to FIG. 9, this extension 66 is raised within the inner circumference of the rotating vanes allowing vane 67 to pass beneath it. This rotation of the cylinder continues until the lower stepped portion 18 of the upper most vane 69 is engaged by the inner surface 70 (See FIG. 4) of arm 60 interrupting the cylinder's rotation.

Premature engagement by arm 62 of the step 18 is prevented by arm 62 being of a shorter length than arm 60, and thus remaining clear of the step's travel path.

When the uppermost vane 69 is engaged by surface 70 of the trigger, the rotational bias of the cylinder pushes against arm 60, which in turn pushes against the upper channel wall 71. This channel wall provides a buttress for the arm 60 of the trigger, rigidly resisting the torsional strength of the cylinder's torque. Without the buttressing affect of portion 71, the cylinder would twist the upper trigger portion 20 allowing the upper vane 69 to rotate beyond the vertical, negatively affecting the gun's accuracy, and the smooth passage of the trigger arm within its channel.

When engaged, the upper vane 69 is aligned with the trigger groove 61 and further pulling of the trigger results in a corresponding elevating engagement of the vane 69 by the arms 60 and 62.

An elastic ring 12 mounted on the vane, conditioned for discharge, may be elevated out of its engagement by being pushed upward and off of the vane by the upper surfaces 72 and 73 of the arms 60 and 62.

A preferred embodiment of the ring is an endless elastic ring 12, circular in shape and round in cross section. Having a round cross section predisposes the ring to roll in its elevation out of engagement, requiring much less mechanical energy to execute. This therefore reduces the necessary amount of strength needed to pull the trigger, making it more easily operated. However, the projectile rings may be in the form of bands composed of elastic materials well known in the prior art. However, unlike bands ejected from prior art devices, projectile rings exhibiting very high tension may be employed in connection with the present invention.

At discharge the trigger reaches the upper limit of its travel when shoulder 39 abuts against the lower edge 41 of the channel wall 27. The trigger may now be manually released under the bias of the trigger spring 25, descending arm 60 and thus releasing the upper vane 69. Simultaneously the lower extension 66 descends into the travel path of vane 75.

An incline 76 cut into extension 66 is formed so as to allow extension 66 to descend fully by avoiding contact with the lowest vane 67.

With the trigger fully released in an at-rest position, extension 66 contacts lower vane 75 and one spoke position movement has been affected. Further pulling and releasing of the trigger mechanism will sequentially rotate the cylinder 13 and discharge the rings 12.

Figure 12:
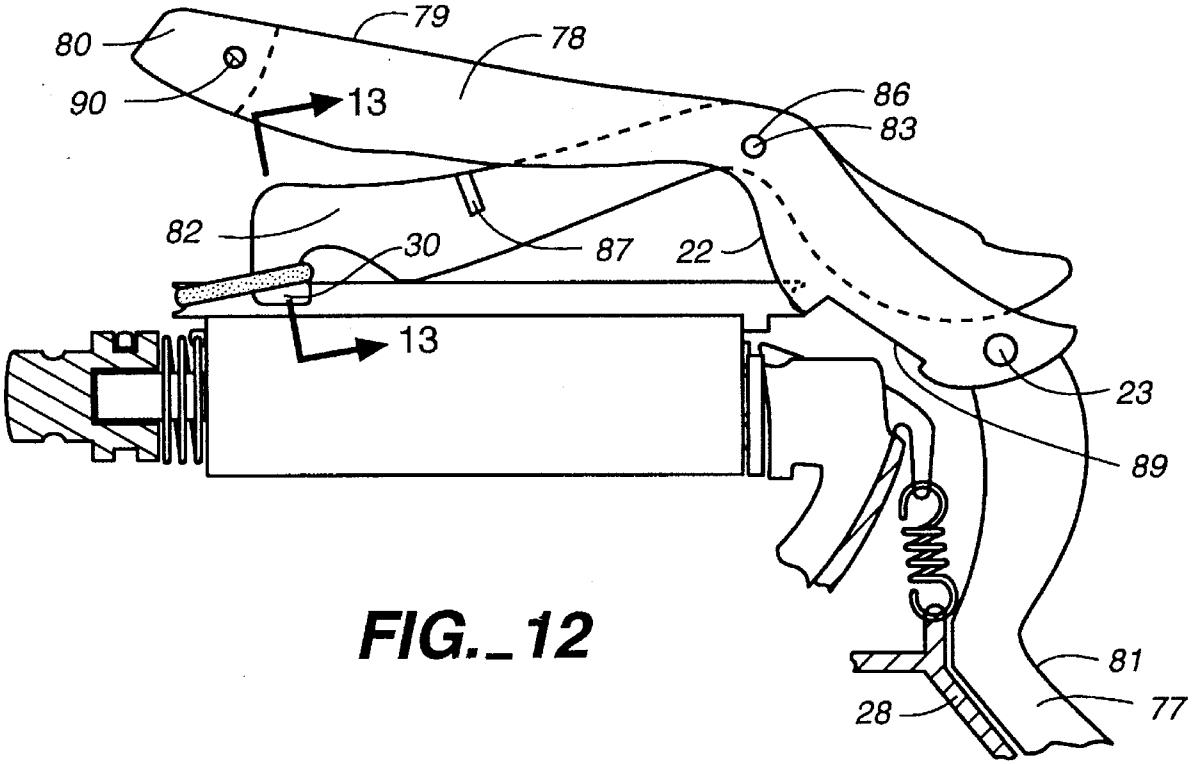
FIG. 12 is a longitudinal view with all vanes but the top one removed.

Referring to FIGS. 1 and 12, the frame portion at the rear of the gun has a continuous opening in the rear wall. An extension of the handle frame 28 together with the handle side walls connected to and rearward of it form a pocket 77. This pocket provides storage space for a lever assembly 22 which is transversely and rotatably mounted at its upper portion to the adjacent side walls by two laterally extending shafts 23, integrally mounted to and extending from the outside of each arm 78 of the lever.

The lever part 79 consists of two plate-like arms 78, joined at their base by an integral connecting portion 80 and arcuately formed to match the contour of the rear edge of the handle frame 81.

The two arms are spaced to receive a hook mechanism 82 which is transversely and rotatably mounted by a shaft 83 to the lever arms. The hook mechanism consists of a solid elongated arm terminating on one end in a pair of hooked extensions 30 separated by a groove 85 and on the opposite end by a transversely positioned hole 86 bored to accept the previously mentioned shaft 83.

Together the lever 79 and the hook 82 cooperate as an assembly that when stored in the handle pocket 77 and abutting extension 28, form the rear wall of the handle.

In use the lever assembly 22 is manually swung out of its pocket in a rearward and upward rotation and the hook mechanism 82 is swung out of its storage space from within the lever 79. The two are cooperatively rotated forward until the hooks 30 lie just above and behind the forward notched end 6 of the upper vane 14.

One end of an endless elastic ring 12 is then passed under and onto the hooks and the other end extended over and onto the forward vane notch 6. See FIG. 12.

With the ring thus attached between hook and notch the lever is manually rotated upward and rearward, which in turn pulls the hook mechanism by its attachment shaft 83 rearward against the resilient pull of the ring. As the hook approaches the rear notched portion of the vane 19, it descends over and onto the vane, with the vane entering groove 85. In this position the ring is tensionally mounted over and onto the rear notch 19 by the continued rearward rotation of the lever. Slightly allowing the lever to move forward under the ring's pull seats the ring onto its receiving notch 19. To prevent the ring from bypassing the notch and mounting below the vane, two shouldered extensions 87 are provided for on either side of the hook which limit its rotation forward and down in the lever when they abut against the corresponding upper surfaces of the lever arms at 89.

This abutted position aligns the ring with the rear notch 19. Any further rearward rotation of the lever lifts the hook upwards to prevent the previously described bypass.

Figure 13:
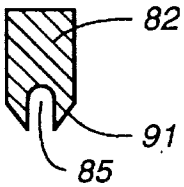
FIG. 13 is a section of the hook taken on the Line 13—13 in FIG. 12.

With the ring mounted on the rear notch, the lever is then rotated upward and forward, which in turn pushes the hook mechanism forward in its straddling position on the vane. Portions of the tensionally mounted ring located on either side of the hook press against the inclined lower surfaces 91, FIG. 13, of the hook which in combination with the hook's forward motion causes the hook to elevate upward out of its position between ring and vane.

This elevating affect allows the hook to egress rapidly and prevent its frictional contact from accidentally unseating the ring from the rear notch.

Cut out section 89, see Jig. 12, in the upper portion of the lever arm provides the lever's forward rotation to be unhindered by contact with the rear upper portion of the trigger assembly.

This lever is also provided with a pair of protrusions 90, one located on either side of the lever's lower portion that frictionally engage the side walls to retain the lever in a stored position when not in use.

The toy gun exhibits a compartment 48 formed from a hollowed out handle portion which may be employed to store a supply of high tension elastic bands usable with the firing mechanism of the present invention. The compartment 48 is provided with a door 50 rotatable from open and closed positions on hinge pin 49. The door 50 is latched in a closed position by means of a latch mechanism 51 which engages an opening in the gun frame 28. Alternatively, the hollowed out ring storage compartment 48 of the handle may be replaced by a cylindrical compartment mounted below the trigger guard and connected to the lower front portion of the handle. High tension elastic rings would be stored in a vertical stacked orientation within this compartment, the forward wall of which, would be open to allow for easy access to the stored rings.

Another variation would be to replace the extensions 87 with an extension, refer to FIG. 12, of the upward/forward corner of the hook mechanism 82 just above the hooks 30. By extending this upper front portion forward, the hook when in the fully pulled rear position above notch 19, would still be supported by the new extension resting on the top of the vane, and the hook and ring thus prevented from descending out of an aligned position.

Although the invention has been described and illustrated in detail, it is intended to be clearly understood that the above is to be taken by way of illustration and example only and not by way of limitation. The spirit and scope of the invention are to be limited only by the terms of the appended claims.

What is claimed is:

1. An elastic band gun capable of propelling a plurality of high tension bands in rapid succession comprising:

an elongate body frame;

longitudinally extending band retaining means rotatably disposed about a longitudinal axis of said frame for retaining a plurality of elastic bands, said retaining means including a plurality of band supporting means, each said band supporting means capable of supporting an individual elastic band in an elongated condition, spring means for biasing said band retaining means for rotation about said longitudinal axis;

positioning means for selectively rotating each said band supporting means into a firing position;

biased trigger means pivotally mounted on said frame for disengaging said elastic bands from said band retaining means; and band lever means for attaching said elastic bands to said supporting means.

2. An elastic band gun according to claim 1, wherein said band supporting means comprises longitudinally extending vane means projecting radially from said band retaining means.

3. An elastic band gun according to claim 1, wherein said spring means is a coil spring and further comprising spring winding means for coiling said coil spring.

4. An elastic band gun according to claim 3, wherein said winding means comprises a ratcheted winding knob engageable with said band retaining means.

5. An elastic band gun according to claim 2, wherein said biased trigger means includes arm means for lifting an end of said band off an end of said vane means.

6. An elastic band gun according to claim 5, including stopping means comprising extension means attached to said arm means for engaging said vane means.

7. An elastic band gun according to claim 6, wherein said stopping means is attached to said trigger means.

8. An elastic band gun according to claim 1, including band disengaging means attached to said trigger means.

9. An elastic band gun according to claim 1, wherein said frame comprises a hollow gun housing having a longitudinally extending elongate top opening defined by opposing side walls, said band retaining means being rotatably disposed about a longitudinal axis in said housing.

10. An elastic band gun according to claim 1, wherein said band retaining means comprises cylinder means.

11. An elastic band gun according to claim 1, wherein said band lever means comprises arm means rotatably disposed on said frame.

12. An elastic band gun according to claim 11, wherein said arm means includes rotatably disposed hook means.

13. An elastic band gun according to claim 11, including handle means having a storage recess for storing said band lever means.

14. An elastic band gun according to claim 1, wherein said positioning means comprises stopping means for selectively preventing rotation of said band retaining means about said longitudinal axis and disengaging means for selectively disengaging said stop means, thereby permitting rotation of another said band supporting means into a firing position.

15. An elastic band gun capable of mounting and releasing a plurality of high tension bands comprising in combination:

a support frame, including a handle, a pawl, and a trigger channel;

a longitudinally extending cylinder rotatably journalled within said support frame by pins mounted axially on the front and rear ends of said cylinder to thus define an axis of rotation, said cylinder having an outer surface with a plurality of radially extending band retaining means each capable of receiving and supporting a high tension band in an elongated condition;

a lever means disposed in fixed relationship to said axis of rotation of the cylinder for mounting said high tension bands on said band retaining means by a mechanical mounting operation;

a lever storage space within said handle for storage of the lever means;

a trigger slidably rotatable within said trigger channel, the upper portion of said trigger comprising a forked member that includes, (1) a cylinder positioning means for incrementally indexing the rotary motion of said cylinder; and (2) a band release means for releasing bands from the band support means, said trigger further including a curved plate-like portion containing a curvilinear shaped trackable lower surface, said curved plate-like portion attached to and lying between the arcuate trigger forward portion and said forked member;

a plurality of rotation limiting means connected to each respective band supporting means, said rotation limiting means (1) engage with said cylinder positioning means to align said band release means with said band retaining means, and (2) to engage with said cylinder positioning means for incrementally indexing cylinder rotation; and a cylinder spring means for biasing said cylinder for rotation about said axis of rotation, said spring means including a hand actuable spindle that engages said pawl so that said cylinder spring means may be energized and the energy incrementally released.

* * * * *